US005342185A

United States Patent [19]

Anderson

[11] Patent Number: 5,342,185

[45] Date of Patent: Aug. 30, 1994

[54] MUFFLER PLATE FOR SCROLL MACHINE

[75] Inventor: Gary J. Anderson, Sidney, Ohio

[73] Assignee: Copeland Corporation, Sidney, Ohio

[21] Appl. No.: 7,652

[22] Filed: Jan. 22, 1993

[51] Int. Cl.[5] ..... F01C 1/04; F01C 19/00

[52] U.S. Cl. ..... 418/55.4; 418/55.5; 418/57; 417/902

[58] Field of Search ..... 418/55.1, 55.4, 55.5, 418/57, 181; 417/902

[56] References Cited

U.S. PATENT DOCUMENTS

| | | | |
|---|---|---|---|
| 4,609,334 | 9/1986 | Muir et al. | 418/57 |
| 4,767,293 | 8/1988 | Caillat et al. | 418/57 |
| 5,055,012 | 10/1991 | Sakashita et al. | 418/55.1 |
| 5,102,316 | 4/1992 | Caillat et al. | 418/55.5 |

FOREIGN PATENT DOCUMENTS

| | | | |
|---|---|---|---|
| 58-170877 | 10/1983 | Japan . | |
| 63-248990 | 10/1988 | Japan | 418/55.1 |
| 3-237283 | 10/1991 | Japan | 418/55.5 |
| 4-101001 | 4/1992 | Japan | 418/55.5 |

*Primary Examiner*—John J. Vrablik
*Attorney, Agent, or Firm*—Harness, Dickey & Pierce

[57] ABSTRACT

A scroll machine has a shell and a muffler plate which defines a muffler chamber and a main chamber. The muffler plate has a face for engaging a seal which is disposed at an interface between the muffler chamber and the main chamber. The muffler plate has a structurally advantageous configuration incorporating a frustoconical portion and a tubular portion, which reduces distortion of the face and thereby reduces leakage between the muffler and main chambers.

20 Claims, 1 Drawing Sheet

MUFFLER PLATE FOR SCROLL MACHINE

BACKGROUND AND SUMMARY OF THE INVENTION

The present invention relates generally to scroll type machines, and more particularly to an improved muffler plate for scroll machines.

Scroll machines are generally provided with a hermetic outer shell. A muffler plate is often used to define a muffler chamber and a main chamber within the shell, each being at a different pressure during normal operation. A scroll assembly is disposed within the main chamber of the shell and includes an orbiting and a non-orbiting scroll member, each having spiral wraps which are mutually intermeshed and define at least one enclosed space of progressively changing volume between a suction pressure region and a discharge pressure region. A flow passage is formed through an end plate of one of the scroll members which allows fluid communication along a flow path between the enclosed space and the muffler chamber, and eventually through a port formed in the hermetic shell. As a result, the muffler plate must allow fluid communication between the enclosed space and the muffler chamber, while effectively sealing the muffler chamber from the main chamber to reduce leakage and enhance the efficiency of the scroll machine.

The muffler plate defines a face for engaging a seal disposed at an interface between the muffler chamber and the main chamber. To maintain effective isolation between the muffler chamber and the main chamber, the muffler plate face should remain in a flat and undistorted condition. Distortion of the face of the muffler plate may be caused for any of several reasons. First, inaccurate alignment or stress where the muffler plate is affixed to the scroll machine may distort the face defined by the muffler plate. Second, the difference in pressure between the muffler chamber and main chamber during normal operation causes a pressure gradient acting across the muffler plate, which may also distort the face. Third, operation of the scroll machine generally creates heat in various locations in the shell, and the resulting heat transfer may cause thermal distortion of the face of the muffler plate.

Accordingly, it is an object of the present invention to provide an improved muffler plate and seal configuration which reduces distortion of the muffler plate face and thereby reduces fluid leakage between the muffler chamber and the main chamber.

Additional advantages and features of the present invention will become apparent from the subsequent description and the appended claims, taken in conjunction with the accompanying drawings.

DETAILED DESCRIPTION OF THE PREFERRED EMBODIMENTS

Figure 1:
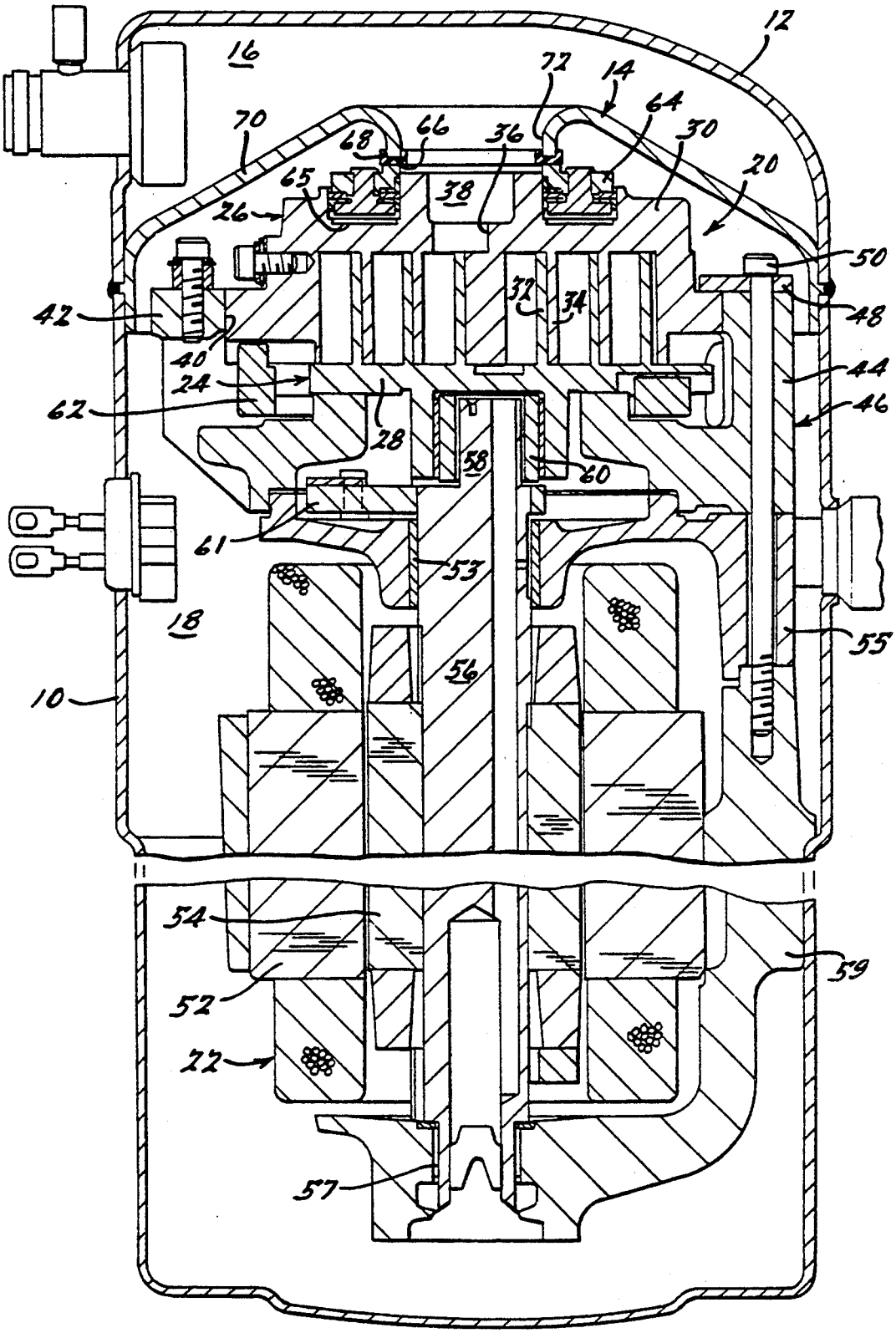
FIG. 1 is a vertical sectional view of a scroll machine incorporating a muffler plate and seal arrangement in accordance with the present invention.

The following description of the preferred embodiments is merely exemplary in nature, and is in no way intended to limit the invention, or its application or uses.

Referring now to the drawing, a scroll machine is shown in FIG. 1 which has a generally cylindrical hermetic shell 10 having affixed at the upper end thereof a cap 12 and a novel muffler plate 14 according to the present invention. Muffler plate 14 defines a muffler chamber 16 and a main chamber 18, each being at a different pressure during normal operation. Muffler chamber 16 extends between muffler plate 14 and cap 12, while main chamber 18 extends between muffler plate 14 and shell 10. A scroll assembly 20 and a motor assembly 22 are disposed within main chamber 18. Compressor assembly 20 includes an orbiting scroll member 24 and a non-orbiting scroll member 26, each having an end plate 28 and 30 and a spiral wrap 32 and 34, respectively. End plate 30 of non-orbiting scroll member 26 has a centrally disposed flow passage 36 communicating with an upwardly open recess 38 which is in fluid communication with muffler chamber 16 through muffler plate 14.

Non-orbiting scroll member 26 is preferably mounted for limited axial compliance in an arrangement of the type disclosed in assignee's co-pending application Ser. No. 863,949 entitled "Non-Orbiting Scroll Mounting Arrangements For A Scroll Machine" filed Apr. 6, 1992, the disclosure of which is hereby incorporated herein by reference. Non-orbiting scroll member 24 is allowed to slide within a radially inwardly facing surface 40 defined by an annular guide ring 42 which is integrally formed with an upper portion 44 of main bearing assembly 46. To limit the axial movement of non-orbiting scroll member 26 in an axial direction away from orbiting scroll member 24, a plurality of stop members 48 are provided which are secured to annular ring 42 by bolts 50.

Motor assembly 22 includes a stator 52 and rotor 54, which drive a drive shaft 56 having an eccentric crank pin 58 for driving orbiting scroll 24 in orbiting motion with respect to non-orbiting scroll 26, whereby spiral wraps 32 and 34 create at least one enclosed space having a volume which progressively changes between a suction pressure region and a discharge pressure region. When the scroll machine is used as a compressor, the suction pressure region and the discharge pressure region are disposed in main chamber 18 and muffler chamber 16, respectively. Drive shaft 56 is rotatably supported by an upper bearing 53 affixed to a lower portion 55 of main bearing assembly 46, and a lower bearing 57 held in place by a lower bearing housing 59. Crank pin 58 is formed with a flat surface (not shown) which drivingly engages a corresponding flat inner surface (not shown) formed within a bushing 60 to provide a radially compliant driving arrangement, such as that shown in assignee's U.S. Pat. No. 4,877,382 entitled "Scroll—Type Machine With Axially Compliant Mounting", the disclosure of which is hereby incorporated herein by reference. A counterweight 61 is affixed to drive shaft 56 and at least partially opposes the centrifugal force caused by the orbiting motion of orbiting scroll 24 and bushing 60. An Oldham coupling 62 is provided to allow orbiting scroll member 24 to engage in orbiting motion without rotation, and may be of the type disclosed in the above referenced U.S. Pat. No. 4,877,382. In addition, the Oldham coupling shown in assignee's co-pending application Ser. No. 591,443 entitled "Oldham Coupling For Scroll Compressor" filed Oct. 1, 1990, the disclosure of which is hereby incorporated herein by reference, may also be used in conjunction with the present invention.

Moreover, the non-orbiting scroll member 26 is preferably provided with an annular floating seal 64 of the type disclosed in assignee's U.S. Pat. No. 5,156,539 entitled "Scroll Machine With Floating Seal", the disclosure of which is hereby incorporated herein by reference. Floating seal 64 is adapted for sliding axial movement with respect to an annular recess 65 formed in the upper surface of end plate 30 of non-orbiting scroll member 26. A passageway (not shown) allows fluid communication between an enclosed space at an intermediate pressure within spiral wraps 24 and 26, and a backpressure chamber defined by recess 65 and floating seal 64. Non-orbiting scroll member 26 is therefore biased toward orbiting scroll member 24. Floating seal 64 tends to maintain engagement with a resilient seal gasket or annular ring 68, regardless of axial movement of non-orbiting scroll member 26.

The novel muffler plate 14 of the present invention is welded to shell 10 and cap 12 by a circumferential weld. Muffler plate 14 defines a face 66 located at an interface between main chamber 18 and muffler chamber 16, which preferably meets with and engages ring 68 disposed between face 66 and a seal seat which is formed in the depicted embodiment by the upper surface of floating seal 64. It is desirable that face 66 remain in a flat and undistorted condition to encourage effective sealing and enhance the efficiency of the scroll machine.

To reduce distortion of face 66, muffler plate 14 is provided with the unique features of a frusto-conical portion 70 and a tubular or cylindrical portion 72. Frusto-conical portion 70 extends radially outwardly from tubular portion 72 substantially to the outer edge of muffler plate 14, and provides a structurally advantageous truncated conical shape which forms a longer and stiffer member than the relatively flat muffler plates of the prior art. Cylindrical portion 72 is preferably centrally located on muffler plate 14 and is generally concentrically disposed about recess 38. Cylindrical portion 72 also provides a structurally advantageous design which cooperates with frusto-conical portion 70 to reduce distortion of face 66 and thereby reduce fluid leakage between muffler chamber 16 and main chamber 18.

Ring 68 is relatively thick and is partially deformed by face 66 of muffler plate 14. Ring 68 is also resilient and tends to absorb relative motion between face 66 and the seal seat defined by floating seal 64. Ring 68 is pressed into place, rather than being firmly affixed to either muffler plate 14 or floating seal 64, and thus ring 68 provides an axially and radially compliant seal gasket at the interface between face 66 and floating seal 64, without introducing additional stress or any distortion which may be caused by welding or brazing.

In an alternative embodiment of the present invention, ring 68 may be omitted and face 66 of muffler plate 14 may be allowed to directly contact the upper surface of floating seal 64. In this embodiment, frusto-conical portion 70 and cylindrical portion 72 of muffler plate 14 operate to reduce distortion of face 66, even in the absence of ring 68.

In another alternative embodiment in which the non-orbiting scroll member is not mounted for axial compliance, floating seal 64 may be omitted. In this embodiment, ring 68 would directly contact a seal seat, such as the upper surface of end plate 30 of non-orbiting scroll 26, and frusto-conical portion 70 and cylindrical portion 72 would still reduce distortion of face 66 of muffler plate 14.

The muffler plate 14 and ring 68 of the present invention provide a complementary structural design having features which reduce distortion of face 66, while allowing the use of a thinner and therefore less expensive material for muffler plate 14 than a conventional relatively flat muffler plate. The muffler plate and compliant ring arrangement of the present invention therefore reduces distortion of face 66 caused by stresses or misalignment of the circumferential weld joining the top cap, muffler plate, and shell, as well as distortion caused by the pressure gradient or any thermal gradients acting across the muffler plate.

It should be understood that an unlimited number of configurations of the present invention can be realized. The foregoing discussion discloses and describes merely exemplary embodiments of the present invention. One skilled in the art will readily recognize from the discussion and from the accompanying drawings and claims that various changes and modifications can be made without departing from the spirit and scope of the invention, as defined in the following claims.

What is claimed is:

1. A scroll machine, comprising:

a hermetic shell;

a first scroll member disposed in said shell and having a first spiral wrap;

a second scroll member disposed in said shell and having a second spiral wrap, said spiral wraps being mutually intermeshed;

means for causing said scroll members to orbit with respect to one another, whereby said wraps create at least one enclosed space of progressively changing volume between a suction pressure region and a discharge pressure region;

a muffler plate having a frusto-conical portion and defining a muffler chamber and a main chamber in said shell each being at a different pressure during normal operation, said muffler plate having a tubular portion defining a face directed toward one of said scroll members; and a seal disposed between said face and said one of said scroll members, said frusto-conical portion and said tubular portion of said muffler plate reducing distortion of said face and thereby reducing fluid leakage between said muffler chamber and said main chamber.

2. The scroll machine as set forth in claim 1, wherein said seal is formed as a resilient gasket which is disposed between said face and said one of said scroll members, said seal tending to absorb relative motion between said face and said one of said scroll members.

3. The scroll machine as set forth in claim 2, which further comprises means for mounting said one of said scroll members for limited axial movement with respect to the other scroll member, said seal further comprising a floating seal operatively connected to said one of said scroll members, said floating seal maintaining engagement with said face regardless of said axial movement of said one of said scroll members.

4. The scroll machine as set forth in claim 1, which further comprises a flow passage through an end plate of one of said scroll members allowing fluid communication along a flow path between said enclosed space and said muffler chamber.

5. The scroll machine as set forth in claim 4, wherein said muffler plate and said seal extend annularly around said flow path.

6. The scroll machine as set forth in claim 5, wherein said seal is formed as a resilient gasket disposed between said face and said one of said scroll members, said seal tending to absorb relative motion between said face and said one of said scroll members.

7. The scroll machine as set forth in claim 6, which further comprises means for mounting said one of said scroll members for limited axial movement with respect to the other scroll member, said seal further comprising a floating seal operatively connected to said one of said scroll members, said floating seal maintaining engagement with said one of said scroll members, said floating seal maintaining engagement with said face regardless of said axial movement of said one of said scroll members.

8. The scroll machine as set forth in claim 1, which further comprises means for mounting said one of said scroll members for limited axial movement with respect to the other scroll member, said seal further comprising a floating seal operatively connected to said one of said scroll members, said floating seal maintaining engagement with said face regardless of said axial movement of said one of said scroll members.

9. The scroll machine as set forth in claim 8, which further comprises a flow passage through an end plate of one of said scroll members allowing fluid communication along a flow path between said enclosed space and said muffler chamber, said seal extending annularly around said flow path.

10. A scroll machine comprising:

a hermetic shell;

a first scroll member disposed in said shell and having a first spiral wrap;

a second scroll member disposed in said shell and having a second spiral wrap, said spiral wraps being mutually intermeshed;

means for causing said scroll members to orbit with respect to one another, whereby said wraps create at least one enclosed space for moving an amount of working fluid between a suction pressure region and a discharge pressure region;

means for mounting one of said scroll members for limited axial movement with respect to the other scroll member;

a muffler plate defining a muffler chamber and a main chamber in said shell each being at a different pressure during normal operation, said muffler plate having a tubular portion defining a face directed axially toward said one of said scroll members; and a floating seal disposed axially between said face and said one of said scroll members, said tubular portion of said muffler plate reducing distortion of said face and thereby reducing fluid leakage between said muffler chamber and said main chamber.

11. The scroll machine as set forth in claim 10, wherein said seal further comprises a resilient gasket which is disposed between said face and said floating seal, said floating seal tending to absorb relative motion between said face and said one of said scroll members.

12. The scroll machine as set forth in claim 11, wherein said floating seal is disposed within said one of said scroll members.

13. The scroll machine as set forth in claim 10, which further comprises a flow passage through an end plate of said one of said scroll members allowing fluid communication along a flow path between said enclosed space and said muffler chamber.

14. The scroll machine as set forth in claim 13, wherein said muffler plate and said seal extend annually around said flow path.

15. The scroll machine as set forth in claim 14, wherein said seal further comprises a resilient gasket disposed between said face and said floating seal, said floating seal tending to absorb relative motion between said face and said one of said scroll members.

16. The scroll machine as set forth in claim 15, wherein said floating seal is disposed within said one of said scroll members.

17. The scroll machine as set forth in claim 10, wherein said floating seal is disposed within said one of said scroll members.

18. The scroll machine as set forth in claim 17, which further comprises a flow passage through an end plate of said one of said scroll members allowing fluid communication along a flow path between said enclosed space and said muffler chamber, said seal extending annularly around said flow path.

19. A scroll machine, comprising:

a hermetic shell having a first and second shell member;

a first scroll member disposed in said shell and having a first spiral wrap;

a second scroll member disposed in said shell and having a second spiral wrap, said spiral wraps being mutually intermeshed;

means for causing said scroll members to orbit with respect to one another, whereby said wraps create at least one enclosed space for moving an amount of a working fluid between a suction pressure region and a discharge pressure region;

a muffler plate defining a muffler chamber and a main chamber in said shell each being at a different pressure during normal operation, said muffler plate having a tubular portion defining a face directed toward one of said scroll members, said first and second shell members and said muffler plate being joined by a common weld; and a seal disposed between said face and said one of said scroll members, said tubular portion of said muffler plate reducing distortion of said face and thereby reducing fluid leakage between said muffler chamber and said main chamber.

20. The scroll machine as set forth in claim 19, which further comprises means for mounting said one of said scroll members for limited axial movement with respect to the other scroll member, and a floating seal operatively coupled with said one of said scroll members for engaging said seal regardless of said axial movement of said one of said scroll members.

* * * * *

UNITED STATES PATENT AND TRADEMARK OFFICE

CERTIFICATE OF CORRECTION

PATENT NO. : 5,342,185

DATED : August 30, 1994

INVENTOR(S) : Gary J. Anderson

It is certified that error appears in the above-identified patent and that said Letters Patent is hereby corrected as shown below:

Column 5, lines 10 & 11, delete "one of said scroll members, said floating seal maintaining engagement with said".

Signed and Sealed this

Sixth Day of December, 1994

Bruce Lehman

*Attest:*

BRUCE LEHMAN

*Attesting Officer*

*Commissioner of Patents and Trademarks*